US007104558B1

(12) United States Patent
Saldana

(10) Patent No.: US 7,104,558 B1
(45) Date of Patent: Sep. 12, 2006

(54) SKATE TRUCK ASSEMBLY

(76) Inventor: Fred Saldana, 927 Calle Negocio, Suite C, San Clemente, CA (US) 92673

( * ) Notice: Subject to any disclaimer, the term of this patent is extended or adjusted under 35 U.S.C. 154(b) by 0 days.

(21) Appl. No.: 11/326,661

(22) Filed: Jan. 5, 2006

(51) Int. Cl.
*A63C 17/00* (2006.01)

(52) U.S. Cl. ..... 280/87.042; 280/11.27; 280/11.28

(58) Field of Classification Search ..... 280/87.042, 280/11.28, 11.19, 11.27, 11.26, 11.209, 87.041, 280/11.25
See application file for complete search history.

(56) References Cited

U.S. PATENT DOCUMENTS

| | | | | |
|---|---|---|---|---|
| 4,103,917 | A * | 8/1978 | Widolf | 280/11.28 |
| 4,109,925 | A * | 8/1978 | Williams et al. | 280/11.28 |
| 4,159,830 | A | 7/1979 | Solimine | |
| 4,166,629 | A * | 9/1979 | List | 280/11.28 |
| 4,168,842 | A | 9/1979 | Kimmell et al. | |
| 5,310,202 | A | 5/1994 | Goodspeed | |
| 5,853,182 | A * | 12/1998 | Finkle | 280/87.042 |
| D421,082 | S | 2/2000 | Lopez | |
| 6,056,302 | A | 5/2000 | Smith | |
| 6,315,304 | B1 | 11/2001 | Kirkland et al. | |
| 6,367,819 | B1 * | 4/2002 | Andersen et al. | 280/11.28 |
| 6,428,023 | B1 | 8/2002 | Reyes et al. | |
| 6,443,471 | B1 | 9/2002 | Mullen | |
| 6,467,782 | B1 | 10/2002 | Smith | |
| 6,474,666 | B1 * | 11/2002 | Andersen et al. | 280/87.041 |
| 6,523,837 | B1 * | 2/2003 | Kirkland | 280/11.28 |
| 6,547,262 | B1 * | 4/2003 | Yamada et al. | 280/11.28 |
| 2002/0043774 | A1 * | 4/2002 | Chou | 280/7.12 |
| 2004/0036243 | A1 * | 2/2004 | Chang | 280/87.042 |
| 2004/0207169 | A1 * | 10/2004 | Kent et al. | 280/87.042 |
| 2004/0245738 | A1 * | 12/2004 | Inchley | 280/87.042 |
| 2005/0051984 | A1 * | 3/2005 | Williams | 280/87.042 |
| 2005/0167938 | A1 * | 8/2005 | Chung et al. | 280/87.042 |
| 2006/0087087 | A1 * | 4/2006 | Stratton | 280/11.27 |

* cited by examiner

*Primary Examiner*—J. Allen Shriver
(74) *Attorney, Agent, or Firm*—Gene Scott, Patent Law & Venture Group

(57) ABSTRACT

A skate truck assembly apparatus provides a hanger engaging separate left and right collinearly aligned axles, and at least three pairs of suspension bushings, with one selected pair of said bushings appropriate to a chosen dynamic load, secured by a kingpin; a base receiving the kingpin in adjustable engagement, thereby mounting the hanger and the at least one suspension bushing in flexible securement on the base; a pivot rod engaged with the hanger and extending therefrom into a rod recess within the base positionally distant from the kingpin.

9 Claims, 3 Drawing Sheets

SKATE TRUCK ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTTED ON A COMPACT DISC

Not applicable.

REFERENCE TO A "MICROFICHE APPENDIX"

Not Applicable.

BACKGROUND OF THE INVENTION

1. Field of the Present Disclosure

This disclosure relates generally to skateboard truck assemblies, and more particularly to such an assembly which has precision ground shafts placed perpendicular to bearing race surfaces and press-fit into a hanger, and wherein rebound and elongation during operation is controlled by changing bushing hardness.

2. Description of Related Art Including Information Disclosed Under 37 CFR 1.97 and 1.98

Lopez, U.S. D421082, discloses an ornamental design for a hanger for a skateboard truck. Yamada et al., U.S. Pat. No. 6,547,262, discloses a truck for skateboards. The preferred skateboard truck comprises a yoke mounted by a king bolt to a mounting base. The mounting base comprises a socket hub and a bracket. The yoke comprises a hanger and a pivot arm. The pivot arm rotates freely in a bearing unit supporting the pivot arm in the socket hub. The king bolt clamps the hanger with a first grommet and a second grommet. The first grommet is flexible, preferably made of urethane rubber, and comprises an edge circumference and a center circumference. The center circumference is narrower than the edge circumference. Preferably, the first and second grommets are fluorescent. Andersen et al., U.S. Pat. No. 6,474,666, discloses a shock absorbing skate truck assembly that includes a resilient shock absorber at the king pin located between the assembly base of the assembly and the axle support member for absorbing shocks encountered during use. Another shock absorber is located in a recess of the assembly base and is engaged by an axle support member arm. The shock absorber in the recess includes a flexible, resilient component and a non-flexible, non-resilient component. Smith, U.S. Pat. No. 6,467,782, discloses a device for use with a skateboard and a skateboard truck assembly to facilitate the removal and replacement of various component parts of a skateboard truck assembly including the bushings and the tension bolt, which is used to join the base plate and the axle assembly. The bolt, which is inserted through the aligned apertures in the axle assembly and the base plate, penetrates into the area beneath the base plate where it emerges and mates with the threaded nut. The device is supported by the bottom surface of the board and held stationary inside a pocket formed within the underside of the base plate and consists of integrally formed components including a generally flat base, a sloped guide platform situated upon the base, and an upstanding heel section formed at the base of the sloped guide platform. The guide platform is constructed according to a specific angle of inclination to fix the nut's orientation and to enable the nut and the threaded end of the bolt to properly align and engage. The upstanding heel section is provided to arrest the nut from deviating from its desired angle and position of alignment. Formed along the center portion of the heel section is a slight recess that aids in the proper positioning of the nut and to keep the nut immobile. Inside the pocket, which receives and generally conforms to the size and shape of the pedestal, is a hollow area, which holds the nut and keeps it confined to prevent rotation. Mullen, U.S. Pat. No. 6,443,471, discloses a skateboard having one or more truck assemblies configured to eliminate undesired ride characteristics such as hanger-jiggle and wheel bite, without sacrificing the skateboard's steering responsiveness. Each truck assembly includes an axle assembly with a ring-shaped hanger that is confined on a kingpin using a pair of bushings, at least one of which includes an annular flange that projects into an annular gap defined between the hanger and the kingpin. This prevents the hanger from moving laterally relative to the kingpin and thereby eliminates undesired ride characteristics such as hanger-jiggle and wheel bite. In a separate feature of the invention, the skateboard truck assembly further incorporates a low-friction slider plate that enhances the rider's performance of certain maneuvers and at the same time protects other components of the truck assembly from undue wear. Reyes et al., U.S. Pat. No. 6,428,023, discloses a truck assembly including a housing adapted to be mounted to a skateboard or the like. An axle bracket is positioned partially in the housing and is mounted for rotation transverse to the longitudinal axis. The axle bracket includes a projecting upper end portion and a bottom end portion adapted to receive a transversely extending axle and wheel assembly. A resilient member, located at least partially in the housing, is provided and is adapted to resist transverse rotation of the axle bracket, and provide a restoring force. In addition, a wedge member is provided, having an aperture configured for receiving the projecting upper end portion of the axle bracket to establish a direct coupling therebetween. For example, the wedge member aperture and the projecting upper end portion of the axle bracket may have complementary, engaging polygonal configurations. The truck assembly may further include a rotational lock subassembly structured to prevent wheel bind during a rider effected turn of the skateboard. Kirkland et al., U.S. Pat. No. 6,315,304, discloses a truck assembly for a skateboard that includes an axle housing, a base, and a kingpin connecting the axle housing and base. The kingpin holds the axle housing and a base surface of the base a predetermined distance apart. The truck further includes a turning mechanism between the axle housing and base, around the kingpin. The turning mechanism includes opposed cam surfaces that are angled along the axis of the kingpin and an elastomeric bushing so that rotating the axle housing about the kingpin pushes the cam surfaces apart, against the compression pressure of the elastomeric bushing. The truck assembly additionally includes an adjustment mechanism for adjusting the pressure against the bushing. The adjustment mechanism includes an adjustment surface on the base of the truck assembly with two or more adjustment points, each a different distance from the base surface along the direction of the kingpin. An adjustment ring surrounds the kingpin, between the base surface and the turning mechanism. The adjustment ring includes adjustment lobes that engage the adjustment surface on the base. Smith, U.S. Pat. No. 6,056,302, discloses a skateboard truck assembly that includes a skateboard, a mounting plate, which is used to mount the truck assembly to the underside of the board, a mounting bracket to bridge the truck assembly to the mounting plate and an axle assembly, which includes axle rods, axle hubs and two wheels. The axle assembly is generally arcuate in shape and includes a lower surface with a more pronounced arcuate design and a central arched section. Each axle rod extends outwardly from the central arched section and slopes down to a terminus point adjacent to the inside portion of the wheel where the axle rod flares relative to the size of the axle hub to conform to the interior sidewall of the wheel and the underside of the flared axle rod coincides in substantial aligned relation with the corresponding wheel tread. Miller, U.S. Pat. No. 5,868,408, discloses a turf board for simulating snowboarding on snow-less terrain. The turf board includes a platform, two wheel assemblies and two bindings. Each of the wheel assemblies includes tires independently attached to a bottom surface of the platform by a shock, absorber suspension. In a preferred embodiment, each of the wheel assemblies include a unique, three-piece rim which maintains the tire. The two bindings are attached to a top surface of the platform for securing a user to the turf board. Finkle, U.S. Pat. No. 5,853,182, discloses a truck assembly for skateboards where the axle assembly is supported on an elastomeric bumper that in turn is supported on an angled shaft. As the skateboard is tilted, the bumper is twisted, causing the axle of the skate assembly to tilt and turn. The bumper is held at one end to the base and at the other end to the axle assembly. Goodspeed, U.S. Pat. No. 5,310,202, discloses a skateboard provided with a low profile and a simplified mechanism for driving without interfering with skateboard steering. A narrow drive belt is entrained about a centrally located pulley integrally mounted on a shaft carrying forward wheels including an overrunning clutch mechanism. A pedal mounted on the front of the board drives a horizontally displaceable rack via an intermediate cam member that provides a variable velocity. The rack in turn drives pinions operative for winding the drive belt around a pulley against spring tension applied at the remote end of the belt. The belt may also be entrained about a rear wheel pulley for empowering the rear wheels of the board. Kimmell et al., U.S. Pat. No. 4,168,842, discloses truck for a skateboard or roller skate, the truck being a unitary assembly having a structure for securing to a member for supporting a rider, the member being in the form of a skateboard or soleplate of a roller skate, the structure being generally rigid and downwardly depending from the undersurface of the rider supporting member with a lower edge lying in a plane diagonally disposed relative to the undersurface. The structure includes an axle-receiving portion for receiving an axle therein with the axle being normally generally parallel to the rider-supporting member and generally perpendicular to the longitudinal centerline thereto. The axle-receiving portion in one embodiment is connected to the lower edge. In the other embodiment a generally flexible web interconnects the lower edge with an upper edge of the axle receiving portion with the two edges in generally parallel relation, with the web in a plane normally perpendicular to the undersurface of the supporting member, the shifting of the weight of the rider deflecting the axle receiving portion relative to the rider supporting member to provide steering. List, U.S. Pat. No. 4,166,629, discloses a skateboard truck that comprises a base a hanger and a coupling assembly. The base has a first portion with a first hole therein and a second portion with a second hole therethrough. The hanger has an axle for mounting wheels thereon, a ring and a pin, the pin being received in the first hole. The axis of the pin coincides with the axis of the first hole and passes through the center of the ring. The coupling assembly is provided for coupling the hanger to the base, the coupling assembly passing through the ring and being received in the second hole. Solimine, U.S. Pat. No. 4,159,830, discloses a wheel truck for a steerable platform such as a skateboard. The wheel truck includes a base frame mounted below the platform and carrying a vertical support shaft and downwardly inclined steering shaft. An axletree upon which wheels are mounted is carried from the frame by resilient support means. The support means includes pairs of elastomeric bushings mounted about both of the support and steering shafts. The bushings are seated in sockets formed in the axletree for positioning the latter with respect to the frame. Fasteners are provided to secure the bushings on the shaft. The fasteners are adapted to change the steering response or to vary angular orientation of the axletree for purposes of changing the turning radius.

The related art described above discloses a range of skateboard truck and wheel assemblies. However, the prior art fails to disclose a skateboard truck assembly with press-fit axle shafts, bushings locked in a fixed position, and the ability to use a bushing hardness appropriate for the weight of the user. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A skate truck assembly has a hanger with left and right collinearly aligned axles engaged with the hanger by sweat-joining technique so that the axles are extending in opposition true to a single axis normal to running bearings. The hanger is further engaged with suspension bushings with a kingpin bolt mounted through the bushings and the hanger into a base receiving the kingpin in adjustable engagement. The hanger and the bushings are flexibly secured to the base. A pivot rod engaged with the hanger extends therefrom into a rod recess within the base distant from the kingpin. The kingpin and the pivot rod form an acute angle configured to improve dynamic operation of the truck with respect to rolling drag and other rearwardly directed forces.

A primary objective inherent in the above described apparatus and method of use is to provide advantages not taught by the prior art.

Other objectives include superior operating characteristics such as less operating noise and vibration, generating less heat, longer life due to a lower fatigue factor, longer bearing life, faster running and lower internal loads.

A further objective is to provide such a truck wherein the kingpin locks urethane bushings in a fixed position allowing compression, rebound and elongation to be controlled by changing bushing hardness.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 1:
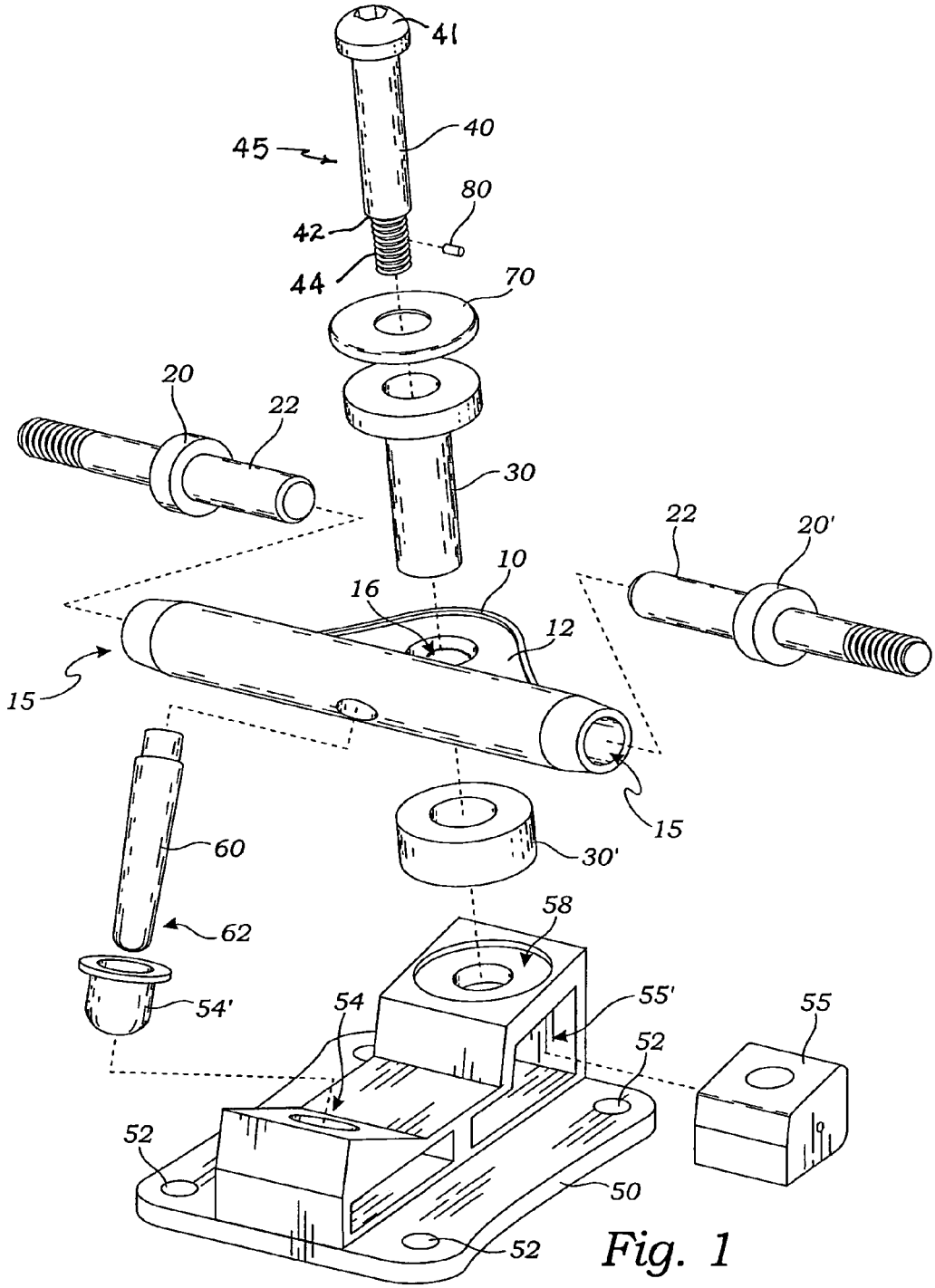
FIG. 1 is a perspective exploded view of the presently described apparatus.

Described now in detail, and as best shown in FIG. 1, is a skate truck assembly apparatus comprising a tubular hanger 10 with left 20 and right 20' collinearly aligned axles engaged with the hanger 10 and extending in opposition therefrom from each side. See common axis 15 in FIG. 2. The axles 20 and 20' are manufactured as separate elements as is hanger 10 and are then joined using sweat joints, i.e., the hanger 10 is heated so as to expand receiving apertures 15; and the axles 20 and 20' are each chilled so as to compress the shafts 22. The assembly of shafts 22 into apertures 15 then takes place holding axles 20, 20' in collinear alignment so that when the several parts are brought to room temperature, true coaxial alignment is attained and retained throughout the useful life of the assembly. This method has been found to be superior in attaining the required alignment tolerance in a highly reliable manner and at low cost.

The hanger 10 is further engaged with a pair of suspension bushings 30 and 30' as will be further described below. Mounted through the bushings 30 and 30' and hole 16 in the hanger 10 is a kingpin 40, a bolt, as best shown in FIG. 1, having a head 41, shaft 45 with shoulder 42, and a terminal, reduced diameter threaded portion 44.

Figure 2:
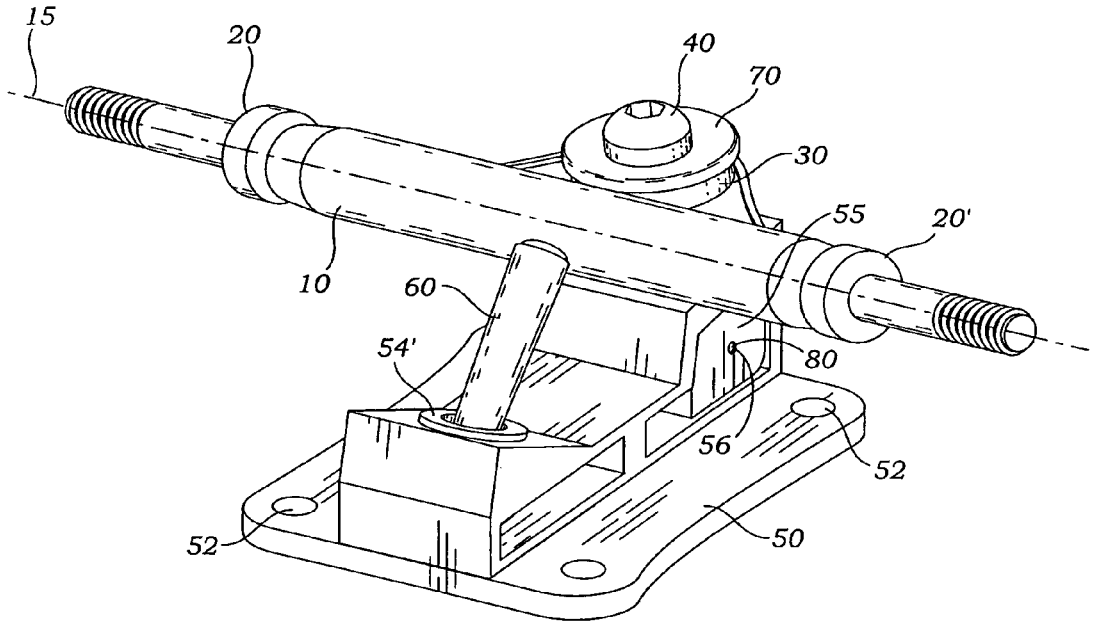
FIG. 2 is a perspective view thereof as assembled.
Figure 3:
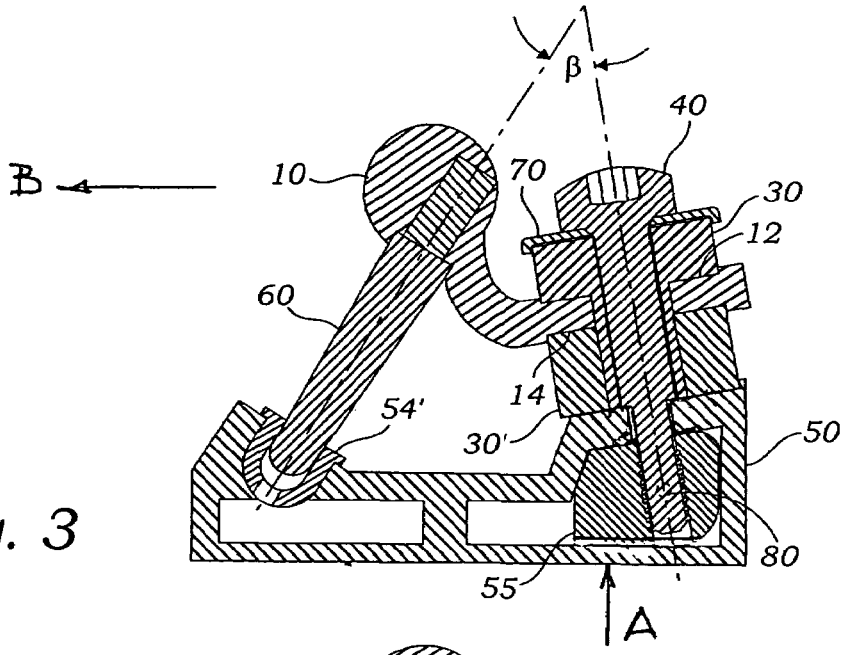
FIG. 3 is a vertical cross-section view thereof.

A structural base 50, preferably made of steel, is adapted with mounting holes 52 for mounting the base 50 to the underside of a skateboard (not shown) as is well known. The kingpin 40 is engaged with the base 50 as shown in FIG. 3 using threaded portion 44 so that the kingpin 40 is rigidly fixed to base 50 thereby mounting the hanger 20 and the bushings 30, 30 in position relative to the base 50 as shown in FIGS. 2 and 3.

A pivot rod 60 is permanently engaged with the hanger 10 extending therefrom into a rod recess 54 within the base 50, where the rod recess is positioned distant from the kingpin 40 as shown in the figures. The kingpin 40 and the pivot rod 60 form an acute angle β of between 40° and 45° and preferably approximately 42° between their longitudinal axes as is best shown in FIG. 3. Angular positioning within this angular range has been shown to provide superior dynamic operation of the apparatus. The resultant force vector on the truck when in use is the sum of the rider's weight vector, see arrow "A" and a drag vector represented by arrow "B" in FIG. 3.

Depending on the relative magnitudes and actual directions of these two vectors bushings 30 and 30' will be compressed and pivot rod 60 will move into compression with pivot bushing 54'. Therefore, the function of pivot rod 60 and pivot bushing 54' is to provide dynamic resistance to changes in angle 13 so that bushings 30 and 30' do not sustain too much compressive strain.

Preferably, the pivot bushing 54' is engaged within the recess 54, the pivot bushing 54' formed in the shape of a cup for receiving a distal end 62 of the pivot rod 60. The suspension bushings 30, 30' are axially aligned as shown in FIG. 3. Preferably, a retaining washer 70 is compressively positioned between the kingpin 40 and the upper suspension bushing 30. The retaining washer preferably has an annular rim 71 or flange to better retain the upper bushing 30.

It should be recognized that the pivot rod 60 is positioned medially between the left and right axles 20, 20' as shown in FIG. 2 to provide a balanced reactive force to both axles.

The base 50 preferably includes a base recess cavity 54 into which insert 54' is preferably pressed and held in place by elastic compression.

The upper and the lower suspension bushings 30, 30' are of a compressible yet extremely hard and durable material such as polyurethane, such that with a neutral compression of the bushings 30, 30', the pivot rod 60 is in an axially aligned position relative to the base recess cavity 54, and with compressive forces applied to bushings 30, 30', pivot rod 60 moves against insert 54' which tends to resist compressively.

Preferably, the flange of hanger 10 provides at least one bushing recess as shown in FIG. 3 for receiving suspension bushing 30 and 30' on surfaces 12 and 14 respectively.

Preferably, the kingpin 40 and the base insert 55 are threadedly engaged as shown, but may also be engaged by other means.

In use, bushings 30 and 30' of differing hardnesses may be exchanged to accommodate riders of widely differing weight. For instance, a rider of between 200 and 250 pounds will require bushings 30 and 30' to have a durometer of between 97 and 98, while a rider of between 150 and 200 pounds will require bushings 30 and 30' to have a durometer of between 96 and 97, and a rider of between 100 and 150 pounds will require bushings 30 and 30' to have a durometer of between 93 and 94. In this way, "rebound" defined as the magnitude of the immediate return response after a compression, and "elongation" defined as the total possible elastic range are maintained within desired limits during use.

Figure 4:
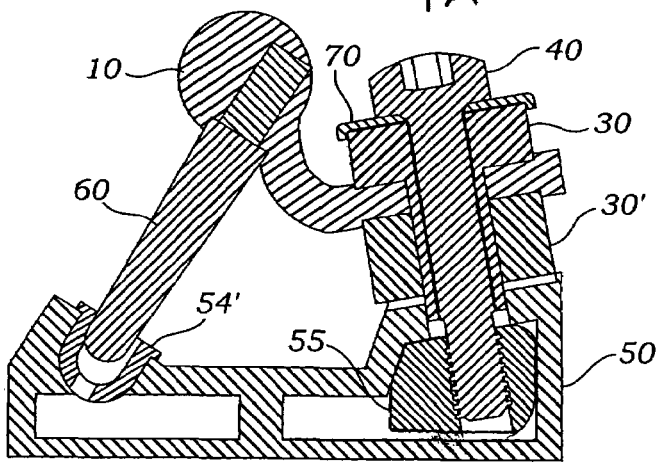
FIG. 4 is a vertical cross-section of a modified version of the presently described apparatus demonstrating operation when a negative load is applied.
Figure 5:
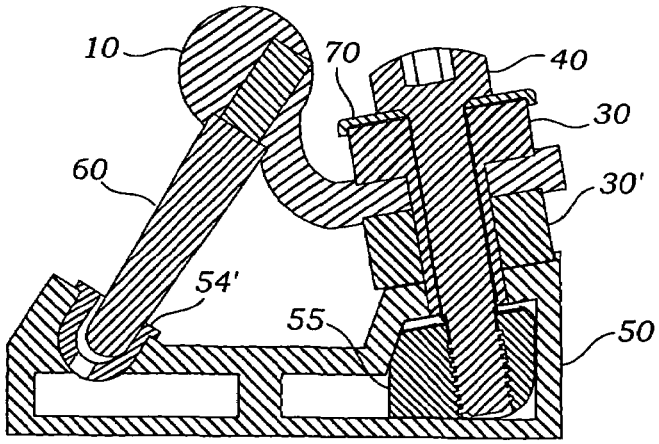
FIG. 5 is a vertical cross-section of the modified version of FIG. 4 demonstrating operation when a positive load is applied.

In FIGS. 4 and 5 is shown an apparatus very similar to the preferred embodiment shown in FIG. 3 and described above. However, the apparatus of FIGS. 4 and 5 uses a kingpin that does not provide shoulder 42 and so is able to move to some extent in the axial direction depending on the direction of load force applied to axles 22. Also, it is common practice among skateboarders to loosen the kingpin to change the stiffness of the suspension. This is not a solution and tends to weaken the assembly and cause excessive wear.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

SEQUENCE LISTING

Not applicable.

What is claimed is:

1. A skate truck assembly apparatus comprising: a tubular hanger with a laterally directed flange; a pair of axles collinearly engaged with the hanger and extending in mutually opposing directions from the hanger; a kingpin providing a shaft, the shaft extending through a pair of compressible suspension bushings, the flange engaged between the bushings and enclosing the shaft; the kingpin providing a terminal fastener portion extending axially from a shoulder of the kingpin; the fastener portion removably engaged with a base, the shoulder abutting the base thereby holding the kingpin immovably thereon; a pivot rod extending rigidly from the hanger and terminating in a rod recess within the base.

2. The apparatus of claim 1 further comprising a pivot bushing engaged within the rod recess, the pivot bushing receiving a distal end of the pivot rod.

3. The apparatus of claim 1 wherein one of the suspension bushings is compressed between a head of the kingpin and the flange, and another of the suspension bushings is compressed between the flange and the base.

4. The apparatus of claim 3 further comprising a retaining washer compressively positioned between the head of the kingpin and the one of the suspension bushings, the retaining washer providing an annular rim axially securing the one of the suspension bushings.

5. The apparatus of claim 1 wherein the pivot rod is positioned medially between the axles.

6. The apparatus of claim 2 wherein the pivot rod is centered in the pivot bushing when the axles are not loaded, and the pivot rod moves to compress the pivot bushing when the axles are loaded.

7. The apparatus of claim 1 wherein the hanger provides at least one bushing recess receiving and axially restraining at least one of the suspension bushings.

8. The apparatus of claim 7 wherein the kingpin and the base are threadedly engaged.

9. The apparatus of claim 1 further comprising a plurality of pairs of the suspension bushings wherein each of the pairs of the suspension bushings provides a separate and distinct selected stiffness coefficient.

* * * * *